US010252879B2

(12) United States Patent
Lotfi et al.

(10) Patent No.: US 10,252,879 B2
(45) Date of Patent: Apr. 9, 2019

(54) BRAKE OPERATION MANAGEMENT IN ELEVATORS

(71) Applicant: Otis Elevator Company, Farmington, CT (US)

(72) Inventors: Amir Lotfi, South Windsor, CT (US); Randall Keith Roberts, Hebron, CT (US); Ronnie E. Thebeau, Haddam, CT (US); Michael Garfinkel, West Hartford, CT (US); Edward Piedra, Chicopee, MA (US); Dennis Hanvey, Leonardo, NJ (US); Daniel Rush, Canton, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/116,120

(22) PCT Filed: Feb. 6, 2014

(86) PCT No.: PCT/US2014/015043
§ 371 (c)(1),
(2) Date: Aug. 2, 2016

(87) PCT Pub. No.: WO2015/119608
PCT Pub. Date: Aug. 13, 2015

(65) Prior Publication Data
US 2017/0174472 A1 Jun. 22, 2017

(51) Int. Cl.
*B66B 1/30* (2006.01)
*B66B 1/32* (2006.01)
(Continued)

(52) U.S. Cl.
CPC ..... *B66B 1/36* (2013.01); *B66B 1/30* (2013.01); *B66B 1/32* (2013.01); *B66B 1/40* (2013.01); *B66B 1/44* (2013.01); *B66B 9/00* (2013.01)

(58) Field of Classification Search
CPC .... B66B 1/30; B66B 1/32; B66B 1/36; B66B 1/40
(Continued)

(56) References Cited

U.S. PATENT DOCUMENTS 4,071,116 A * 1/1978 Halperin ..... B66B 1/3484 187/392
4,194,594 A 3/1980 Ishii et al.
(Continued)

FOREIGN PATENT DOCUMENTS

EP 0137102 A1 * 4/1985 ..... B66B 1/3492
JP H0672656 A 3/1994
(Continued)

OTHER PUBLICATIONS

European Search Report for application EP 14881761.2, dated Aug. 31, 2017, 13pgs.
(Continued)

*Primary Examiner* — David Warren
(74) *Attorney, Agent, or Firm* — Cantor Colburn LLP

(57) ABSTRACT

Embodiments are directed to determining that an elevator car of an elevator system is approaching a landing, obtaining, by a controller, a value for at least one parameter associated with the elevator system based on the determination that the elevator car is approaching the landing, determining that the elevator car arrives at the landing within a threshold distance, determining, by the controller, when to engage in at least one of a brake cycling operation and a power cycling operation based on the value for the at
(Continued)

least one parameter and based on determining that the elevator car arrives at the landing within the threshold distance, and initiating the at least one of a brake cycling operation and a power cycling operation at a time corresponding to the determination of when to engage in the at least one of a brake cycling operation and a power cycling operation.

14 Claims, 1 Drawing Sheet

(51) Int. Cl.

| | |
|---|---|
| ***B66B 1/36*** | (2006.01) |
| ***B66B 1/40*** | (2006.01) |
| ***B66B 1/44*** | (2006.01) |
| ***B66B 9/00*** | (2006.01) |

(58) Field of Classification Search
USPC ..... 187/247
See application file for complete search history.

(56) References Cited

U.S. PATENT DOCUMENTS 4,278,150 A * 7/1981 Wehrli, III ..... B66B 1/16 187/293
4,975,627 A 12/1990 Reddy
5,155,305 A * 10/1992 Horbruegger ..... C23C 14/56 187/293
5,693,919 A * 12/1997 Sager ..... B66B 5/027 187/282
6,483,047 B1 11/2002 Zaharia et al.
2005/0230192 A1* 10/2005 Brant ..... B66B 1/40 187/284
2008/0087502 A1* 4/2008 Zapf ..... B66B 1/3492 187/394
2009/0032340 A1 2/2009 Smith
2011/0240412 A1 10/2011 Schienda et al.
2013/0327598 A1* 12/2013 Rebillard ..... B66B 1/32 187/280
2015/0014098 A1* 1/2015 Stolzl ..... B66B 5/0031 187/248
2015/0344266 A1* 12/2015 Inoue ..... B66B 1/3492 324/207.15
2016/0280511 A1* 9/2016 Anderson ..... B66B 5/0031
2017/0174472 A1* 6/2017 Lotfi ..... B66B 1/36

FOREIGN PATENT DOCUMENTS

| | | | |
|---|---|---|---|
| JP | 2009113874 | A | 5/2009 |
| KR | 0179673 | B1 | 4/1999 |
| KR | 100179673 | B1 | 4/1999 |
| WO | 2009110907 | A1 | 9/2009 |

OTHER PUBLICATIONS

Angermann et al., "A Reference Measurement Data Set for Multisensor Pedestrian Navigation with Accurate Ground Truth", available at: https://www.researchgate.net/publication/225001848_A_Reference_Measurement_Data_Set_for_Multisensor_Pedestrian_Navigation_with_Accurate_Ground_Truth, accessed Aug. 2, 2016, 6 pages.
International Search Report and Written Opinion for application PCT/US2014/015043, dated Oct. 29, 2015, 12 pages.
Jimenez, Antonio et al., "PDR with a Foot-Mounted IMU and Ramp Detection", available at http://www.ncbi.nlm.nih.gov/pmc/articles/PMC3231264/, accessed Sep. 27, 2012, 7 pages.

* cited by examiner

BRAKE OPERATION MANAGEMENT IN ELEVATORS

BACKGROUND

Code or regulations that have been enacted for elevator systems may require the elevator system to drop or engage a brake at least once in the time period between an elevator car stopping at a first landing or floor and then leaving that first landing/floor for a second landing/floor. The code/regulations may also require the elevator system to de-energize at least a portion of the propulsion system (e.g., drive or motor) during that time period.

In conventional elevator systems, as an elevator car approaches a destination landing or floor, the elevator car decelerates. When the elevator car reaches a condition of near zero velocity with the car sufficiently close to the desired floor landing the brake is dropped. Then, as the doors open and the load in the elevator car changes (e.g., as passengers in the elevator car exit the elevator car), if the elevator car moves away from the sill level in an amount greater than a threshold (e.g., 0.5 inches), the elevator system is required to perform a re-leveling operation to bring the elevator car back to the landing within the threshold. To perform the re-leveling operation, the elevator system may check a safety chain as part of a pre-flight check, pre-torque the motor, lift the brake, and then follow a motion profile to correct the elevator car's position.

The elevator system may initiate a re-leveling operation multiple times at a landing based on the changes or transfer of load at the landing (e.g., exit or entry of passengers or freight). The timing of the power cycling and brake drop-and-lift is critical, especially when the hoisting components are very compliant, such as in high-rise systems or buildings. For example, if the brake cycling happens shortly after arrival at a destination landing, fast load transfer leads to an excessive amount of movement, representing a risk. On the other hand, if the brake cycling is delayed until just before the elevator car is ready to depart from a landing, it adds to the start delay for a given run, representing a user or passenger nuisance. This invention describes a control system concept which can optimize the re-leveling and brake control operation.

Re-leveling may need to be performed in high-rise systems or buildings more frequently relative to smaller buildings or structures due to longer ropes/cables used in the high-rise buildings having greater elasticity (and hence, being more susceptible to elevator car movement in response to load transfer). Elevator systems and infrastructure are tending to increase in size or capacity (e.g., stacked elevator cars) to accommodate more passengers or load, which leads to a potential increase in load transfer dynamics/changes. Re-leveling operations are not instantaneous, but incur delay due the need to verify proper operation of safety circuits and change the state of the brake (e.g., lift the brake) and the state of the machine or motor (e.g., energize/pre-torque the machine or motor).

BRIEF SUMMARY

An embodiment is directed to a method comprising: determining that an elevator car of an elevator system is approaching a landing, obtaining, by a controller, a value for at least one parameter associated with the elevator system based on the determination that the elevator car is approaching the landing, determining that the elevator car arrives at the landing within a threshold distance, determining, by the controller, when to engage in at least one of a brake cycling operation and a power cycling operation based on the value for the at least one parameter and based on determining that the elevator car arrives at the landing within the threshold distance, and initiating the at least one of a brake cycling operation and a power cycling operation at a time corresponding to the determination of when to engage in the at least one of a brake cycling operation and a power cycling operation.

An embodiment is directed to an apparatus comprising: at least one processor, and memory having instructions stored thereon that, when executed by the at least one processor, cause the apparatus to: determine that an elevator car of an elevator system is approaching a landing, obtain a value for at least one parameter associated with the elevator system based on the determination that the elevator car is approaching the landing, determine that the elevator car arrives at the landing within a threshold distance, determine when to engage in at least one of a brake cycling operation and a power cycling operation based on the value for the at least one parameter and based on determining that the elevator car arrives at the landing within the threshold distance, and initiate the at least one of a brake cycling operation and a power cycling operation at a time corresponding to the determination of when to engage in the at least one of a brake cycling operation and a power cycling operation.

An embodiment is directed to an elevator system comprising: at least one elevator car configured to traverse a hoistway, a machine, a brake, a controller configured to: determine that the at least one elevator car is approaching a landing, obtain a value for at least one parameter associated with the elevator system based on the determination that the at least one elevator car is approaching the landing, determine that the at least one elevator car arrives at the landing within a threshold distance, determine when to engage in at least one of a brake cycling operation as applied to the brake and a power cycling operation as applied to the machine based on the value for the at least one parameter and based on determining that the at least one elevator car arrives at the landing within the threshold distance, and initiate the at least one of a brake cycling operation and a power cycling operation at a time corresponding to the determination of when to engage in the at least one of a brake cycling operation and a power cycling operation.

An embodiment is directed to a method comprising: determining a load or a number of passengers in an elevator car of an elevator system before arriving at a landing and the load or number of passengers waiting to enter the car at the landing based on at least one of: load weighing data, motor torque, vision and image processing, an output of a platform load cell inside the elevator car or in a hall located proximate to the elevator system, a hall call and a car call, and building security system data.

An embodiment is directed to an elevator system comprising: at least one elevator car configured to traverse a hoistway, a machine, a brake, a controller configured to: determine that the brake has been dropped when the at least one elevator car is located at a particular landing, and based on determining that the brake has been dropped, causing the elevator system to engage in a motion profile away from the particular landing.

Additional embodiments are described below.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
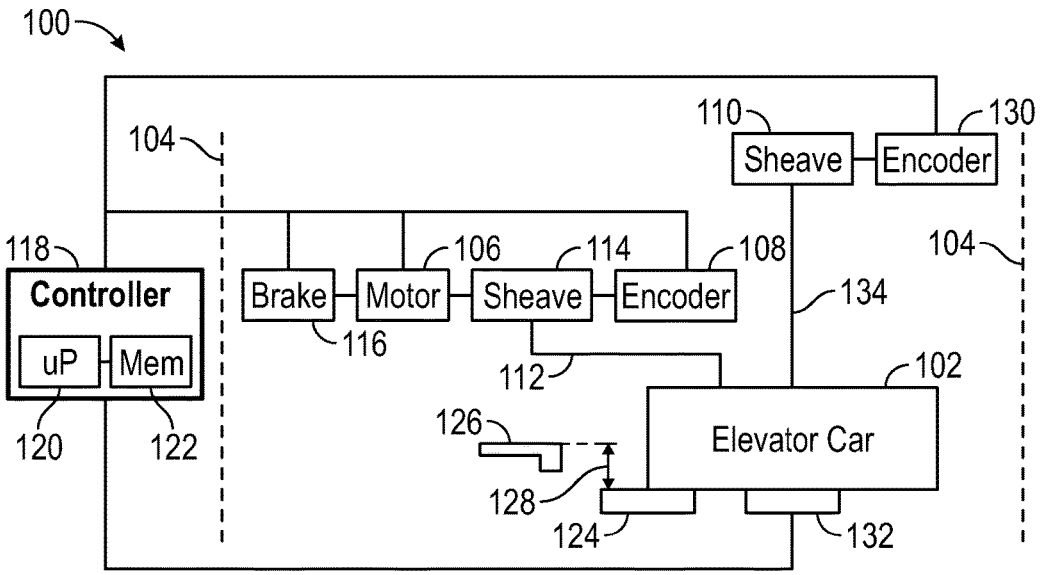
FIG. 1 illustrates an exemplary elevator system.

It is noted that various connections are set forth between elements in the following description and in the drawings (the contents of which are included in this disclosure by way of reference). It is noted that these connections in general and, unless specified otherwise, may be direct or indirect and that this specification is not intended to be limiting in this respect. In this respect, a coupling between entities may refer to either a direct or an indirect connection.

Exemplary embodiments of apparatuses, systems and methods are described for safely and effectively controlling an elevator. In some embodiments, the timing of brake and power cycling at a landing may be determined using a constant delay or based on one or more parameters, such as motor torque, load weighing, or car acceleration. Load in an elevator car may be monitored while, e.g., passengers or objects are exiting the elevator car. The brake may be dropped and/or a machine (e.g., motor) may be de-energized when the elevator car is nearly empty, thereby providing enough time for cycling when the last passengers are exiting and the next group of passengers are entering the elevator.

Referring to FIG. 1, a block diagram of an exemplary elevator system 100 is shown. The organization and arrangement of the various components and devices shown and described below in connection with the elevator system 100 is illustrative. In some embodiments, the components or devices may be arranged in a manner or sequence that is different from what is shown in FIG. 1. In some embodiments, one or more of the devices or components may be optional. In some embodiments, one or more additional components or devices not shown may be included.

The system 100 may include an elevator car 102 that may be used to convey, e.g., people or items such as freight up or down an elevator shaft or hoistway 104. The elevator car 102 may include an input/output (I/O) interface that may be used by passengers of the system 100 to select a destination or target landing floor, which may be specified in terms of a floor number. The elevator car 102 may include one or more panels, interfaces, or equipment that may be used to facilitate emergency operations.

The elevator car 102 may be coupled to a motor 106 via a drive sheave 114 and tension members 112. The motor 106 may provide power to the system 100. In some embodiments, the motor 106 may be used to propel or move the elevator car 102.

The motor 106 may be coupled to an encoder 108. The encoder 108 may be configured to provide a position of a machine or motor 106 as it rotates. The encoder 108 may be configured to provide a speed of the motor 106. For example, delta positioning techniques, potentially as a function of time, may be used to obtain the speed of the motor 106. Measurements or data the encoder 108 obtains from the motor 106 may be used to infer the state of the elevator car 102.

The system 100 may include a secondary sheave 110 that is connected to the elevator car 102 via tension members 134. The secondary sheave 110 may be a speed governor or a special car position device. The tension members 134 are designed to have low tension levels to provide good positive engagement with the sheave 110 so that the position and/or velocity of the elevator car 102 may be inferred from the encoder 130. In some embodiments, the tension members 112 may include one or more ropes, cables, chains, etc. In some embodiments, the tension members 134 may include belts or slotted metallic tape.

The system 100 may include a brake 116. The brake 116 may be engaged or dropped in an effort to secure the elevator car 102 at a particular height or elevation within the hoistway 104.

The system 100 may include, or be associated with, a controller 118. The controller 118 may include one or more processors 120, and memory 122 having instructions stored thereon that, when executed by the processor 120, cause the controller 118 to perform one or more acts, such as those described herein. In some embodiments, the processor 120 may be at least partially implemented as a microprocessor (uP). In some embodiments, the memory 122 may be configured to store data. Such data may include position, velocity, or acceleration data associated with the elevator car 102, motor torque data, load weighing data 132, etc.

In some embodiments, the controller 118 may receive or obtain information or data associated with one or more parameters. For example, the controller 118 may obtain information regarding motor torque, load weighing, or car acceleration, velocity, or position. In some embodiments, the controller 118 may receive such information from one or more sensors, such as encoder 108, encoder 130, the desired landing floor location 126, and a load weighing sensor 132 that may be located at an attachment point on the elevator car 102, such as under the platform or at the attachment point of the tension members 112.

As the elevator car 102 arrives at the desired landing floor 126, the elevator doors will open and passengers may move into and out of the car. This transfer of weight will cause the tension members 112 to elongate or contract thus causing the elevator car sill 124 to move vertically relative to the landing floor sill 126. The difference between the landing sill 126 and the car sill 124 is referred to as sag 128. It is desired that the elevator system 100 minimize the amount of car sag 128 during passenger and payload transfers into and out of the elevator car 102. The controller 118 can use the difference between encoder 130 and encoder 108 to estimate the car sag 128 and use this signal to initiate or end the re-leveling operation.

In some embodiments, brake or power cycling (e.g., the timing associated with brake or power cycling) may be based on a load weighing signal 132. The load weighing signal 132, which may correspond to load weighing data, may serve to indicate a load that is present in the elevator car 102. When the elevator car 102 has arrived at a destination floor or landing 126, the load weighing signal 132 may be monitored. If the load weighing signal 132 changes in an amount that is less than a threshold over a given time period, then a determination may be made that the brake 116 can be dropped and/or the machine (e.g., the motor 106) may be de-energized. In this manner, the sag due to load transfers can be minimized.

In some embodiments, brake or power cycling (e.g., the timing associated with brake or power cycling) may be based on a determination or prediction of load (e.g., passengers) that may be exiting or entering the elevator car 102 as the elevator car 102 approaches a first destination floor or landing as part of a run. For example, if the system 100 or controller 118 knows that fifteen passengers are in the elevator car 102 as the elevator car 102 is approaching the first destination landing, and if the system 100 or controller 118 knows that at least twelve of the fifteen passengers are going to exit the elevator car 102 when the elevator car 102 arrives at the first destination landing, the elevator car 102 may be subjected to a re-leveling operation (shortly) upon arrival at the first destination landing. Further refinements may be made in embodiments where the identity of passengers is determined or estimated, such as in embodiments where the passengers request elevator service using a device that is personal to them (e.g., a smart phone). In some embodiments, brake or power cycling may be based on an estimate of incoming passenger traffic. The estimate of incoming passenger traffic may be based on historical data.

In some embodiments, such as when an elevator car (e.g., car 102) is idle at a landing with the brake dropped, the system 100 (or a component or device thereof) may anticipate a heavy load is about to enter the elevator car 102. Such anticipation may be based on knowledge regarding assigned passengers that are due to enter the elevator car 102, load sensors located in the hallway, a vision and image processing system observing the hallway, elevator dispatching inputs, or building security inputs. The system 100 can start or initiate re-leveling before the passengers have even entered the car 102 in order to minimize the sag 128.

Figure 2:
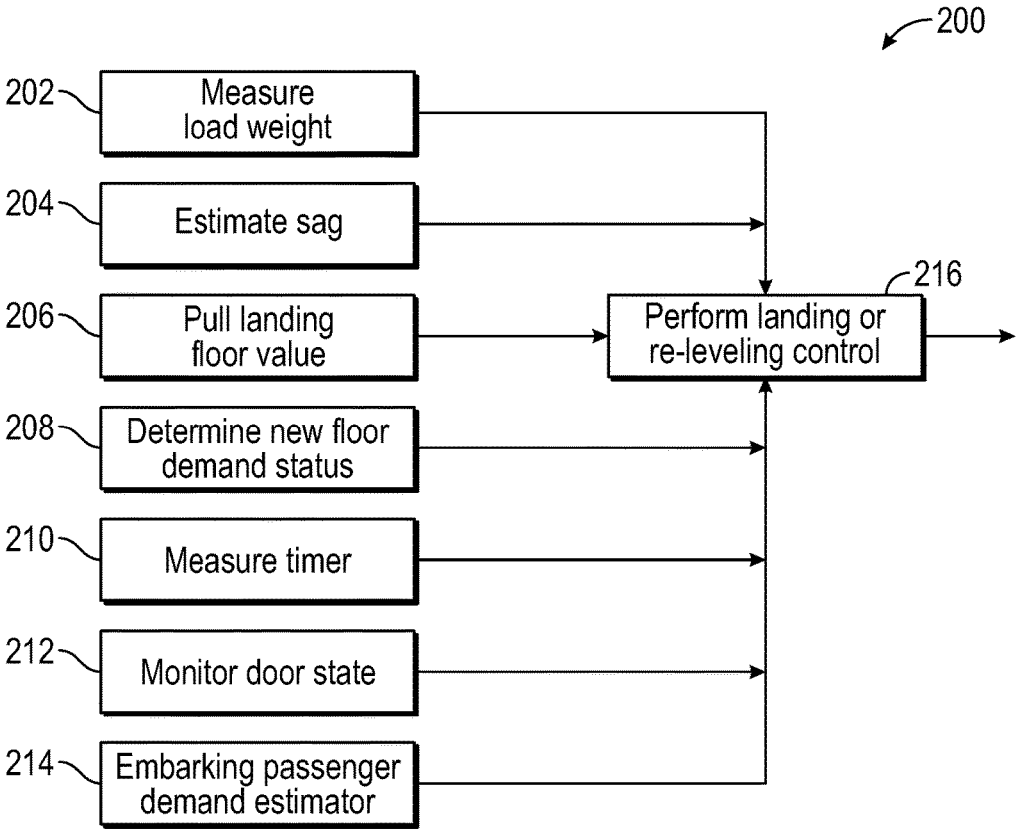
FIG. 2 illustrates a block diagram of an exemplary method.

Turning now to FIG. 2, a flow chart of an exemplary method 200 is shown for managing re-leveling and brake or power cycling in the controller 118. The method 200 may be executed by, or tied to, one or more systems, components, or devices, such as those described herein. The method 200 may be used to determine an appropriate time for an elevator system to engage in re-leveling, brake or power cycling, potentially as part of an elevator run. This system is operational as the elevator car 102 approaches the desired floor landing 126, collecting measurement signals to optimize the re-leveling control function.

In block 202, the load weight signal 132 is measured continuously throughout the landing and re-leveling phases of the elevator operation.

In block 204, an estimate of the amount of elevator car sag 128 is made continuously throughout the landing and re-leveling phases of the elevator operation. The determination of this estimate can be based on measurement signals from the motor encoder 108 and the secondary sheave encoder 130 for example. Other position system or sag estimation techniques may be used which directly or indirectly measure sag which work in conjunction or independently from these encoder signals.

In block 206, the value of the landing floor is pulled from the elevator controller memory 122 defining where in the building the elevator car is to land at.

In block 208, the input from the elevator car is monitored and recorded to indicate if a request has been made to service a new landing from the present landing.

In block 210, a timer is measured to record how much time has elapsed during the time from initially landing at the floor.

In block 212, the door state information from the car is monitored and recorded to indicate if the doors are opening, open, closing, or closed.

In block 214, the embarking passenger demand at the landing floor 126 is estimated based on sensor input or controller signals.

In block 216, the signals from the previous blocks are used to determine the optimal requests to satisfy the landing or re-leveling operational needs of the system as it is being loaded or unloaded at the landing floor. The outputs of this block would be requests to open or close the brake 116, energize or de-energize the motor 106, and initiate corrective motion requests from the controller 118 to the motor 106 to reduce the sensed value of car sag 128.

As the elevator car 102 approaches the desired landing 126 the control block 216 can decide to drop the brake based on the sensed load weight 202 and landing floor 206. If the car weight indicates the car is full and the landing floor is near the bottom of a very high rise elevator then the best solution could be to not drop the brake, but to rather go directly from the normal motion profile dictation into the floor to re-leveling anticipating the need for re-leveling as the full car unloads.

As the elevator car 102 is in the re-leveling mode of operation at a lower landing in the building as determined by the landing floor signal 206, the control block 216 can optimize the time to lift or drop the brake based on one or more of, e.g., the sag estimator 204, load weight signal 202, and the timer 210. The sag estimate 204 would define when the sag value is back within the desired threshold. When this is true, the load weight and timer signals can be used to assess whether it is likely or unlikely that load transfers have been completed by looking at how much the load weight signal varies over a time window. If this signal varies more than a set threshold, then the re-leveling operation should continue. If this signal has shown little change (e.g., changed less than a threshold) then it is likely that the re-leveling operation can be stopped and the brake dropped.

The door signal 212 and new floor demand signal 208 can be used by the control block 216 to determine if a re-leveling operation should be stopped and transitioned into a brake drop/safety check condition. The control block 216 can record how many brake drop cycles occurred in the window of operation at the landing floor 126. If none had occurred, then when the doors are closed and new demand is noted, the system needs to stop re-leveling and drop the brake.

The method 200 is illustrative. In some embodiments, one or more of the blocks or operations (or portions thereof) may be optional. In some embodiments, the operations may execute in an order or sequence different from what is shown. In some embodiments, one or more additional operations not shown may be included. In some embodiments, one or more of the blocks or operations may execute repeatedly, potentially as part of a background task.

Embodiments of the disclosure may be used to select an appropriate or optimum time for an elevator system to cycle or change the state of power or braking as applied to the elevator system. The timing may be selected to minimize errors or to minimize the number of times or the extent of re-leveling that may be needed. In this manner, the elevator system may be operated more efficiently, component/device wear and use may be minimized, and delays incurred as part of the elevator system operation may be minimized.

In some embodiments various functions or acts may take place at a given location and/or in connection with the operation of one or more apparatuses, systems, or devices. For example, in some embodiments, a portion of a given function or act may be performed at a first device or location, and the remainder of the function or act may be performed at one or more additional devices or locations.

Embodiments may be implemented using one or more technologies. In some embodiments, an apparatus or system may include one or more processors and memory storing instructions that, when executed by the one or more processors, cause the apparatus or system to perform one or more methodological acts as described herein. In some embodiments, one or more input/output (I/O) interfaces may be coupled to one or more processors and may be used to provide a user with an interface to an elevator system. Various mechanical components known to those of skill in the art may be used in some embodiments.

Embodiments may be implemented as one or more apparatuses, systems, and/or methods. In some embodiments, instructions may be stored on one or more computer-readable media, such as a transitory and/or non-transitory computer-readable medium. The instructions, when executed, may cause an entity (e.g., an apparatus or system) to perform one or more methodological acts as described herein.

Aspects of the disclosure have been described in terms of illustrative embodiments thereof. Numerous other embodiments, modifications and variations within the scope and spirit of the appended claims will occur to persons of ordinary skill in the art from a review of this disclosure. For example, one of ordinary skill in the art will appreciate that the steps described in conjunction with the illustrative figures may be performed in other than the recited order, and that one or more steps illustrated may be optional.

What is claimed is:

1. A method comprising:

determining that an elevator car of an elevator system is approaching a landing;

obtaining a value for at least one parameter associated with the elevator system based on the determination that the elevator car is approaching the landing;

determining that the elevator car arrives at the landing within a threshold distance;

determining when to engage in at least one of a brake cycling operation and a power cycling operation based on the value for the at least one parameter and based on determining that the elevator car arrives at the landing within the threshold distance;

initiating the at least one of a brake cycling operation and a power cycling operation at a time corresponding to the determination of when to engage in the at least one of a brake cycling operation and a power cycling operation;

monitoring load weighing data based on determining that the elevator car arrives at the landing within the threshold distance; and determining that the load weighing data indicates that a load associated with the elevator car changes in an amount that is less than a threshold over a given period of time;

wherein the at least one of a brake cycling operation and a power cycling operation is initiated based on the determination that the load weighing data indicates that the load associated with the elevator car changes in the amount that is less than the threshold over the given period of time.

2. The method of claim 1, further comprising:

obtaining at least one characteristic regarding the use of the elevator system, wherein the determination of when to engage in the at least one of a brake cycling operation and a power cycling operation is based on the obtained at least one characteristic.

3. The method of claim 2, wherein the at least one characteristic comprises at least one of:

a count or identity of passengers currently in the elevator car, a count or identity of passengers outside of the elevator car requesting service using the elevator car, one or more landings serving as a source of origin for the passengers outside of the elevator car, one or more destination landings for one or more of the passengers, an estimate of incoming passenger traffic based on historical data, and an identification of any large objects or freight to be conveyed by the elevator car.

4. The method of claim 2, further comprising:

causing the elevator system to re-level the elevator car upon the arrival of the elevator car at the landing within the threshold distance based on the at least one characteristic.

5. The method of claim 1, further comprising:

subsequent to determining that the elevator car arrives at the landing, determining a load that is anticipated to enter the elevator car at the landing; and initiating a re-leveling of the elevator car based on the anticipated load prior to the anticipated load entering the elevator car at the landing.

6. The method of claim 1, wherein the initiating of the at least one of a brake cycling operation and a power cycling operation comprises dropping a brake of the elevator system.

7. The method of claim 1, wherein the initiating of the at least one of a brake cycling operation and a power cycling operation comprises de-energizing a machine of the elevator system.

8. An apparatus comprising:

at least one processor; and memory having instructions stored thereon that, when executed by the at least one processor, cause the apparatus to:

determine that an elevator car of an elevator system is approaching a landing;

obtain a value for at least one parameter associated with the elevator system based on the determination that the elevator car is approaching the landing;

determine that the elevator car arrives at the landing within a threshold distance;

determine when to engage in at least one of a brake cycling operation and a power cycling operation based on the value for the at least one parameter and based on determining that the elevator car arrives at the landing within the threshold distance; and initiate the at least one of a brake cycling operation and a power cycling operation at a time corresponding to the determination of when to engage in the at least one of a brake cycling operation and a power cycling operation;

monitor load weighing data based on determining that the elevator car arrives at the landing within the threshold distance, determine that the load weighing data indicates that a load associated with the elevator car changes in an amount that is less than a threshold over a given period of time;

initiate the at least one of a brake cycling operation and a power cycling operation based on the determination that the load weighing data indicates that the load associated with the elevator car changes in the amount that is less than the threshold over the given period of time.

9. The apparatus of claim 8, wherein the at least one of a brake cycling operation and a power cycling operation comprises a dropping of a brake of the elevator system.

10. The apparatus of claim 8, wherein the at least one of a brake cycling operation and a power cycling operation comprises a de-energizing of a machine of the elevator system.

11. An apparatus comprising:

at least one processor; and memory having instructions stored thereon that, when executed by the at least one processor, cause the apparatus to:

determine that an elevator car of an elevator system is approaching a landing;

obtain a value for at least one parameter associated with the elevator system based on the determination that the elevator car is approaching the landing;

determine that the elevator car arrives at the landing within a threshold distance;

determine when to engage in at least one of a brake cycling operation and a power cycling operation based on the value for the at least one parameter and based on determining that the elevator car arrives at the landing within the threshold distance;

initiate the at least one of a brake cycling operation and a power cycling operation at a time corresponding to the determination of when to engage in the at least one of a brake cycling operation and a power cycling operation;

monitor load weighing data based on determining that the elevator car arrives at the landing within the threshold distance;

determine that the load weighing data indicates that a load associated with the elevator car changes in an amount that is greater than a threshold over a given period of time; and continue to cause a re-leveling of the elevator car to occur and keep a brake of the elevator system up based on the determination that the load weighing data indicates that the load associated with the elevator car changes in the amount that is greater than the threshold over the given period of time.

12. An elevator system comprising:

at least one elevator car configured to traverse a hoistway;

a machine;

a brake;

a controller configured to:

determine that the at least one elevator car is approaching a landing;

obtain a value for at least one parameter associated with the elevator system based on the determination that the at least one elevator car is approaching the landing;

determine that the at least one elevator car arrives at the landing within a threshold distance;

determine when to engage in at least one of a brake cycling operation as applied to the brake and a power cycling operation as applied to the machine based on the value for the at least one parameter and based on determining that the at least one elevator car arrives at the landing within the threshold distance; and initiate the at least one of a brake cycling operation and a power cycling operation at a time corresponding to the determination of when to engage in the at least one of a brake cycling operation and a power cycling operation;

monitor load weighing data based on determining that the elevator car arrives at the landing within the threshold distance, determine that the load weighing data indicates that a load associated with the elevator car changes in an amount that is less than a threshold over a given period of time;

initiate the at least one of a brake cycling operation and a power cycling operation based on the determination that the load weighing data indicates that the load associated with the elevator car changes in the amount that is less than the threshold over the given period of time.

13. The elevator system of claim 12, wherein the elevator system is included in a high-rise building.

14. The elevator system of claim 12, wherein the at least one elevator car comprises a plurality of elevator cars stacked on top of one another.

* * * * *